United States Patent [19]

Bibber

[11] Patent Number: 4,895,608

[45] Date of Patent: Jan. 23, 1990

[54] CORROSION RESISTANT ALUMINUM COATING COMPOSITION

[75] Inventor: John W. Bibber, Batavia, Ill.

[73] Assignee: Sanchem, Inc., Chicago, Ill.

[21] Appl. No.: 187,828

[22] Filed: Apr. 29, 1988

[51] Int. Cl.[4] ..... C23C 22/07

[52] U.S. Cl. ..... 428/427.2; 148/261

[58] Field of Search ..... 148/261; 428/427.2

[56] References Cited

U.S. PATENT DOCUMENTS

| | | |
|---|---|---|
| 1,607,676 | 11/1926 | Zirota . |
| 1,677,667 | 7/1928 | Zimmerman . |
| 1,710,743 | 4/1929 | Page . |
| 1,811,298 | 6/1931 | Boulanger . |
| 1,965,269 | 7/1934 | Touierno . |
| 2,276,353 | 3/1942 | Thompson . |
| 2,465,443 | 3/1949 | Gide . |
| 2,512,493 | 6/1953 | Gide . |
| 2,681,893 | 3/1956 | Deniston . |
| 2,785,091 | 3/1957 | Rex . |
| 2,820,731 | 1/1958 | Heinzelman et al. . |
| 2,883,311 | 4/1959 | Halpert . |
| 2,981,647 | 4/1961 | Schwartz . |
| 3,516,877 | 6/1970 | Papafingos et al. . |
| 3,573,997 | 3/1971 | Plaxton . |
| 3,706,604 | 12/1972 | Paxton . |
| 3,749,596 | 7/1973 | Nara . |
| 3,752,708 | 8/1973 | Newell et al. . |
| 3,871,881 | 3/1975 | Mikelsons . |
| 4,145,234 | 2/1979 | Meissner . |
| 4,427,458 | 1/1984 | Hasegawa et al. . |
| 4,755,224 | 7/1988 | Bibber . |

FOREIGN PATENT DOCUMENTS

| | | |
|---|---|---|
| 2406411 | 8/1974 | Fed. Rep. of Germany ..... 148/261 |
| 1259617 | 1/1972 | United Kingdom . |

OTHER PUBLICATIONS

Grant, *Hackh's Chemical Dictionary,* 4th Edition 1969, p. 114.

Asada-Chemical Abstracts, vol. 64, p. 17044.

Reschke, et al. Chemical Abstracts vol. 36, p. 5760.

Collari, 9 Metallurgy and Metallography p. 5814.

Collari, et al Chemical Abstracts p. 4760.

Seidell, et al American Chemical Society 1964.

Berdzenishvili, et al 72-Electrochemistry 156854s vol. 102, 1985.

Mikhailovskii, et al-Chemical Abstracts 182163u vol. 100, 1984.

Plenkova et al 72 Electrochemistry 93394c vol. 100, 1984.

El-Sobki, et al 72 Electrochemistry 112211h vol. 96, 1982.

Bruno, et al—Chemical Abstracts 97914z vol. 66, 1967.

Kravchenko, et al 20 Nonferrous Metals and Alloys, 6738.

Albert Cotton, et al, 72 Advanced Inorganic Chemistry 853, 25-D-6.

*Primary Examiner*—Sam Silverberg

*Attorney, Agent, or Firm*—Laff, Whitesel, Conte & Saret

[57] ABSTRACT

The invention relates to aluminum conversion coating compositions and the resulting aluminum alloy protected with the conversion coating. The aluminum or aluminum alloy is coated with a composition having as its essential ingredients phosphate ions, aluminum ions and nitrate ions with the preferred coating having the phosphate ions supplied by phosphoric acid and the nitrate ions supplied by aluminum nitrate with the aluminum ions present in at least 900 ppm, the phosphate ions present in at least 3170 ppm and the nitrate ions present in at least 6200 ppm.

11 Claims, No Drawings

CORROSION RESISTANT ALUMINUM COATING COMPOSITION

The present invention relates to a corrosion resistant coating for aluminum and aluminum alloys, an aluminum and aluminum article coated with an intermediate protective coating, and the process for coating aluminum and aluminum alloys with a protective corrosion resistant coating.

BACKGROUND OF THE INVENTION

Generally, aluminum or aluminum alloys are protected by forming thereon an intermediate corrosion resistant conversion coating and then painting over the corrosion resistant coating. Therefore, the corrosion resistant coating must be intimately bonded to the aluminum surface and also provide the required adhesion with the desired final aluminum coating—i.e., paint.

One of the widely used processes for protecting aluminum and aluminum alloys with a corrosion resistant intermediate coating is to coat the surface of the aluminum and aluminum alloys with a protective conversion coating of an acid based hexavalent chromium composition or other heavy metal such as zirconium and titanium.

All of these processes leave a very thin film of a heavy metal salt on the aluminum or aluminum alloy which prevents the metal from becoming dark when subjected to boiling water for periods of time up to 30 minutes. These coating also provide a suitable base for the application and retention of other coatings, such as paint, to the aluminum or aluminum alloy surfaces.

Also, hexavalent chromium has been widely accepted as an intermediate corrosion resistant conversion coating because it protects aluminum alloy surfaces such as 2024 for extended periods of time. The hexavalent chromium provides a corrosion resistant coating which can withstand a salt fog bath for more than 168 hours. The coated aluminum or aluminum alloy is placed in a salt fog at 95° according to ASTM method B-117 for at least 168 hours and then removed. This requirement is necessary for many applications. Further, the hexavalent chromium composition provides an intermediate coating which is receptive to the application and retention of other coatings, such as paints, to the aluminum or aluminum alloy surfaces.

The excellent features of the hexavalent chromium composition, have made these compositions used extensively for the corrosion resistant protection of aluminum and aluminum alloys and as an intermediate corrosion resistant coating.

However, the hexvalent chromium compositions have a serious side effect. Chromium is highly toxic and the spent chromium compositions provide an ecological problem. Many people in the industry are attempting to eliminate this ecologically damaging waste problem and it is very costly.

Other corrosion resistant compositions have been suggested, as noted in my applications 07/086,362 filed Aug. 17, 1987.

SUMMARY OF THE INVENTION

My invention eliminates some of the problems of the hexavalent chromium and other heavy metal compositions by providing a corrosion resistant coating composition which, if desired, contains no chromium or other similar toxic materials.

Also, for aluminum alloys having at least 1.0% Cu, we provide a corrosion resistant coating which can withstand a salt fog at 95° F. according to ASTM Method B-117 for at least 168 hours.

I form on the aluminum or aluminum alloy surface a clear colorless coating consisting of aluminum phosphate ($AlpO_4$) and/or aluminum oxide ($Al_2O_3$) to provide a coated surface which will resist blackening or other discoloration even after being subjected to boiling water for up to 30 minutes. In accordance with my invention, I provide an aqueous treatment or coating solution which contains as essential ingredients aluminum, phosphate and nitrate in dissolved form. Such solutions are used to treat a bright shiny aluminum surface in a manner such that the bright shiny appearance of the surface is not changed, while forming on the surface a uniform colorless coating which is corrosion resistant and to which overlying coatings adhere.

As to the source of the aluminum, any soluble aluminum salt such as aluminum chloride, nitrate or sulphate may be used. Aluminum nitrate is preferable. The phosphate may come from any soluble phosphate. Phosphoric acid is preferable. The nitrate may also come from any soluble nitrate. Aluminum nitrate is preferred. This can be used to supply both the nitrate and aluminum.

The coating solution for use in this process has an acid pH. The preferred pH is 0–1.50.

My phosphate composition preferably contains an aqueous solution of the following:

| INGREDIENT | CONCENTRATION, PPM |
|---|---|
| $Al^{+3}$ | 900-saturation |
| $PO_4^{-3}$ | 3,710-saturation |
| $NO_3^{-1}$ | 6,200-saturation |

The aluminum or aluminum alloy surface is normally immersed in my aqueous solution at temperatures preferably of 110° F. to 160° F. for a period of at least 15 seconds. As the temperature is raised less immersion time is required to form the corrosion resistant coating. Lower temperatures may be used, but will require longer immersion time.

In the case of aluminum alloys having a Cu content of greater than 1%, i.e. 2024 aluminum alloy, I first degrease and clean the alloy and then deoxidize and oxidize the alloy. The oxidized alloy is first treated with a permanganate solution for a predetermined time. The permanganate coated alloy is then treated with my phosphate, aluminum and nitrate composition for a predetermined time. This coating is rinsed and then the alloy is coated with a second permanganate solution for a predetermined time at a predetermined temperature. The alloy is again rinsed and given a final treatment with an alkali metal silicate and a final rinse.

In the above process the preferred aluminum alloy to be protected are those in the 2000 series—i.e, 2024 aluminum alloy having an average composition of 4.4% Cu, 0.6% Mn, 1.5% Mg and 93.5% Al.

The preferred degreaser and cleaner is a non-ionic surfactant such as Triton X-100 from Rohm and Haas Corp.

The outer oxide layer is removed preferably with a sulfuric and nitric acid mixture.

The first permanganate coating solution contains:

1. 0.2 to 6.3% by weight alkali metal permanganate preferably 2 to 4% with the alkali metal being potassium, and 2. 0.05 to 9% by weight alkali metal borates and I their hydrates—preferably 0.5 to 2% Borax.10 ($Na_2B_47.10H_2O$).

The second permanganate solutions contain in addition to the alkali metal permanganate and the alkali metal borate, 0.05 to 10% by weight of alkali metal chloride preferably 0.5 to 2% lithium chloride.

One aspect of this invention is to provide a protective coating for aluminum and aluminum alloys, which has as essential ingredients aluminum, phosphate and nitrate.

Another aspect of the invention is to provide an improved process for providing corrosion resistant coating for aluminum alloys of the 2000 series.

The alkali metal permanganate compositions may be applied in any acceptable manner (i.e., immersion, spraying, misting or spreading by an appropriate applicator). I! The aluminum or aluminum alloy surface is normally immersed in my aqueous alkali metal permanganate solution which contains the essential ingredients. The temperature of the solution is between room temperature and the boiling point of the composition. The preferred temperature is between 60° and 80° F., with the most preferred between 100° and 180° F. However, as the temperature is raised, less immersion time is necessary to form the desired coating.

The alkali metal as referred to herein is selected from potassium, sodium or lithium.

The preferred alkali metal permanganate is potassium or sodium permanganate.

The concentration of the permanganate, to provide 168 hours of salt fog protection for the aluminum or aluminum alloys is of a sufficient amount to provide at least 700 ppm of manganese in the coating solution with the practical maximum being the saturation point of the permanganate. When potassium permanganate is used, a concentration of 0.2% by weight is about 700 ppm manganese. At room temperature, a saturated $KMnO_4$ solution is 6.3% by weight; 32° F. is 2.8% by weight and at 212° F. is 28% by weight. The sodium permanganate is infinitely soluble and, therefore, has no practical upper limit.

The preferred alkali metal chloride is NaCl or LiCl. The concentration of the NaCl or LiCl is generally within the range of 0.05–10% by weight of the solution and preferably within the range of 0.1 to 5% by weight of the solution.

Other compounds may be added to the permanganate solutions if desired, providing the compounds do not interfere with the desired corrosion resistant protection of the aluminum or aluminum alloy surfaces.

The cleaning compounds for the aluminum or aluminum alloy surfaces are sodium hydroxide, alkaline solutions of sodium nitrate, hydrofluoric acid, sulfuric acid, nitric acid, sodium carbonate, borax, and a commercial non-ionic surfactant polyoxyethylene or polyoxypropylene derivatives of organic acids, alcohols, alkylphenols or amines, a commercial non-ionic surfactant which I have used is a polyoxyethylene derivative or organic acids such as "Triton X-100" sold by Rohm and Haas Corp.

It is also recommended that neither the cleaning composition nor the corrosion resistant alkali metal permanganate composition contain a fatty acid, or any compound which would interfere with adhesion or formation of a protective coating on the aluminum or aluminum alloy surface.

In the following Examples 1–4, the aluminum surfaces treated with the solutions identified in the examples were drawn and ironed aluminum cans which were first degreased, as necessary, and then cleaned to a break-free surface with an acidic aqueous cleaner such as hydrofluoric acid. Unless stated otherwise, the coating solutions were applied by dipping for about 15 seconds. After treatment with the solutions identified in the examples, the aluminum surfaces were rinsed in deionized water, dried and tested for corrosion by placing in boiling water for 15 to 30 minutes.

The aluminum surfaces treated in the examples, unless otherwise stated, were also treated for paint adhesion by painting with an interior vinyl-lacquer, dried for 24 hours, and then placed in a 1% solution of detergent for 15 minutes at 180° F. The painted surface was then cross-hatched using a sharp metal object to expose lines of aluminum. Cellophane tape was firmly attached over the cross-hatched area and quickly removed. Any removal of paint was evidence of a failure. No failures were observed.

EXAMPLE 1

An aluminum can, cleaned to break-free surface, was immersed for 30 seconds in a solution consisting of:

1.25% aluminum nitrate nine hydrate ($Al(NO_3)_3.9H_2$), 0.45% phosphoric acid ($H_3PO_4$) (85%) and 98.35% water at 160° F. After rinsing with deionized water it was placed in boiling deionized water for 15 minutes and showed no change in color. Paint adhesion was excellent.

EXAMPLE 2

An aluminum can, cleaned to break-free surface, was immersed for 30 seconds in a solution consisting of:

2.5% aluminum nitrate ($Al(NO_3)_3.9H_2$), 0.9% phosphoric acid 85% ($H_3PO_4$) and 96.6% water at 150° F. After rinsing with deionized water it was placed in boiling deionized water for 15 minutes and showed no change in color. Paint adhesion was excellent.

EXAMPLE 3

An aluminum can, cleaned to break-free surface, was immersed for 15 seconds in a solution consisting of: 2.0% aluminum nitrate ($Al(NO_3)_3.9H_2O$), phosphoric acid 85% ($H_{PO4}$) and 94.4% water at 110° F. After rinsing with deionized water it was placed in boiling deionized water for 15 minutes and showed no change in color. Paint adhesion was excellent.

EXAMPLE 4

An aluminum can, cleaned to break-free surface, was immersed for 15 seconds in a solution consisting of:

30.0% aluminum nitrate ($Al(NO_3)_3.9H_2O$), 20.0% phosphoric acid 85% ($H3PO_4$) 94.4% water at 110° F. After rinsing with deionized water it was placed in boiling deionized water for 30 minutes and showed no change in color. Paint adhesion was excellent.

My phosphate-aluminum-nitrate compositions are particularly valuable for protecting the outer surfaces of aluminum and aluminum alloy cans that are widely used for various beverages. My coating allows the cans to be protected for up to 30 minutes without having the can discolor. This permits the can to have the desired finished coating and colors.

In the following example 5, I use a combination of coatings to coat aluminum alloy 2024. The aluminum alloy is usually used for or in combination with heavy equipment. This type of alloy generally needs protection for long periods of time.

EXAMPLE 5

An aluminum alloy panel of "2024" alloy (has on average a composition of: 4.4% Cu, 0.6% Mn, 1.5% Mg and 93.5% A1 was degreased and cleaned to a break-free finish with a commercial non-ionic surfactant such as Triton X-100 from Rohm and Haas Corp. The outer oxide layer of the metal was removed by dipping the panel in a solution of 15% sulfuric acid, 10% nitric acid and 75% water at 140° F. for seven minutes.

After further treatment in 70% nitric acid for one minute, the panel was rinsed in deionized water and placed in deionized water containing less than 1.0 PPM total impurities at 195°-212° F. for five minutes to form a thin layer of boehmite (A10 . . . H) on the surface of the panel.

Treatment of the panel at 155°-160° F. for 2 minutes in a solution of: 3.0% Potassium Permanganate ($KMNO_4$), 1.0% Borax ($Na_2B_4O_7.10H_2o$) and 96.0% water was followed by rinsing with deionized water and treatment for two minutes at 135°-140° F. in a solution of:

2.5% aluminum nitrate ($Al(NO_3)_39H_2O$), $0.9H_2O$), 0.9% phosphoric acid (85%) ($H_3PO_4$) and 96.6% water. After again rinsing in deionized water the panel was given a two minute treatment in a solution of:

3.0% Potassium Permanganate ($KMNO_4$), 1.0% Borax ($Na_2B_4O_7.10H_2O$), 1.0% Lithium Chloride (LiCl) and 95% water at 155°-160° F. After rinsing with deionized water the panel was given a final treatment in an aqueous solution of potassium silicate (0.83% $K_2O$ and 2.% $SiO_2$) at 195°-200° F. for five minutes and rinsed again with deionized water. The panel was placed in a salt-fog at 95° F. according to ASTM standard B-117 (sample at a 6° angle). After 168 hours of exposure, there were no noticeable pits in the treated area of the panel.

Our examples show use of protective compositions that do not have toxicity of chromates and are therefore more environmentally effective.

I claim:

1. An aluminum or aluminum alloy article having been coated with an intermedaite coating composition having as essential ingredients phosphate ions, aluminum ions, and nitrate ions wherein the aluminum ions are present in at least 900 ppm, the phosphate ions are present in at least 3170 ppm and the nitrate ions are present in at least 6200 ppm and said phosphate composition has a pH of less than 1.5.

2. The article of claim 1 wherein the phosphate ions are supplied by phosphoric acid and the aluminum and nitrate ions are supplied by aluminum nitrate.

3. An alluminum alloy article being coated with at least three intermediate coating compositions with a phosphate coating composition being between a first and second permanganate coating compositions, said phosphate coating composition having as essential ingredients phosphate ions, aluminum ions and nitrate ions wherein the aluminum ions are present in at least 900 ppm, the phosphate ions are present in at least 3170 ppm and the nitrate ions are present in at least 6200 ppm and said phosphate composition has a pH of less than 1.5.

4. The article of claim 3 wherein the first and second permanganate coating compositions have as essential ingredients alkali metal permanganate and a borate compound selected from the group consisting of alkali metal tetraborate, alkali metal metaborate, a mixture of the alkali metal meta and tetraborate, and the hydrated alkali metal meta and/or tetraborate.

5. The article of claim 4 wherein the second permanganate coating composition also contains an alkali metal chloride.

6. The article of claim 5 wherein the permanganate is potassium permanganate, the borate is borax and the chloride is lithium chloride.

7. The article of claim 6 wherein the phosphate ions are supplied by phosphoric acid and the nitrate and aluminum ions are supplied by aluminum nitrate.

8. The article of claim 7 wherein in the first permanganate composition there is

| | |
|---|---|
| 0.2-6.3% | potassium permanganate |
| 0.5-9% | borax.10 |
| 99.3-84.7% | water |

in the second permanganate composition there is

| | |
|---|---|
| 0.2-6.3% | potassium permanganate |
| 0.5-9% | Borax.10 |
| 0.05-10% | lithium chloride; |
| 99.25%-74.7% | water |

and in the phosphate composition there is phosphoric acid, aluminum nitrate and water

9. The article of claim 8 wherein the article is composed of an aluminum alloy of the 2000 series.

10. A process for protecting an aluminum alloy having greater than 1.0% Cu comprising after cleaning and degreasing the alloy, rinsing the alloy, deoxidizing the rinsed alloy; coating the deoxidized alloy with a first permanganate coating composition; rinsing; coating with an aqueous phosphate solution having as essential ingredients phosphate ions, nitrate ions and aluminum ions; rinsing; coating with a second permanganate coating composition; rinsing, and treating with potassium silicate wherein the aluminum ions are present in at least 900 ppm, the phosphate ions are present in at least 3170 ppm and the nitrate ions are present in at least 6200 ppm and said phosphate composition has a pH of less than 1.5.

11. The process of claim 15 wherein the first permanganate coating composition contains as essential ingredients:

0.05% to 9% by weight borax-$10H_{20}$ and 0.2 to 6.3% by weight of $KMnO_4$; the second permanganate coating composition contains as essential ingredients 0.05 to 9% by weight borax $110H_{20,\ 0.2}$ to 6.3% $KMnO_4$ and 0.05 to 10% LiCl; and the phosphate composition contains as essential ingredients phosphoric acid and aluminum nitrate.

* * * * *